United States Patent [19]

Bakker

[11] 4,397,295

[45] Aug. 9, 1983

[54] BURNER FOR BURNING PULVERIZED FUEL

[76] Inventor: Aalbert Bakker, Franselaan 260, 3028 AS Rotterdam, Netherlands

[21] Appl. No.: 204,839

[22] Filed: Nov. 7, 1980

[30] Foreign Application Priority Data

Nov. 12, 1979 [NL] Netherlands ..... 7908259

[51] Int. Cl.[3] ..... F23M 9/00

[52] U.S. Cl. ..... 431/185; 110/261; 110/264; 431/352

[58] Field of Search ..... 431/352, 353, 185; 110/261, 264, 265, 251, 252

[56] References Cited

U.S. PATENT DOCUMENTS

| | | | |
|---|---|---|---|
| 1,450,229 | 4/1923 | Robinson | 110/261 |
| 2,560,074 | 7/1951 | Bloomer | 110/264 |
| 4,132,180 | 1/1979 | Frederick | 110/264 |
| 4,318,355 | 3/1982 | Nelson | 110/261 |

FOREIGN PATENT DOCUMENTS

| | | |
|---|---|---|
| 919732 | 11/1954 | Fed. Rep. of Germany . |
| 2729476 | 1/1979 | Fed. Rep. of Germany . |
| 994132 | 11/1951 | France . |

*Primary Examiner*—James C. Yeung

[57] ABSTRACT

A burner for burning pulverized fuel, especially pulverized lignite or coal, comprises a combustion chamber 1, and an ignition chamber 2 having an ignition burner 9. A supply line 5 for powder and air for pneumatic conveyance debouches into the ignition chamber 2. Further combustion air may be fed through outflow means 8 into the combustion chamber. To achieve a short flame as well as an improved homogeneity of the distribution of the mixture, the burner includes a distribution pipe 3, the surface of which being provided with a large number of openings 11. The supply line 5 for powder and conveying air terminates into the distribution pipe 3, preferably a rotating movement being imparted to the mixture flowing along the wall of the distribution pipe 3.

3 Claims, 2 Drawing Figures

BURNER FOR BURNING PULVERIZED FUEL

Figure 1:
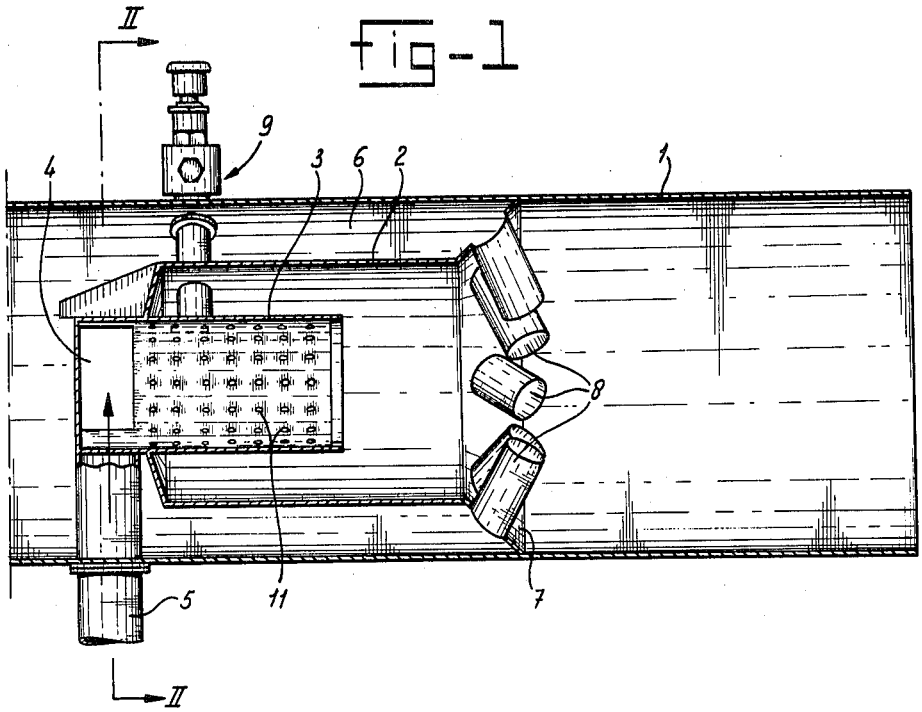

The invention relates to a burner for burning pulverized fuel, said burner comprising a combustion chamber, an ignition chamber connected to said combustion chamber and provided with an ignition device, an inlet debouching into said ignition chamber for supplying powder and pneumatic conveyance air, and means for supplying combustion air debouching into said combustion chamber at approximately the location of the connection between the ignition chamber and the combustion chamber.

A long flame which can only be ignited with difficulty is avoided in such a burner by providing at least one baffle plate at relatively short distance from the debouchement of the supply pipe for the mixture of powder and conveying air. This baffle plate causes an irregular turbulence of the fuel flow already ignited whereby a more intimate admixing of the components is achieved. The employment of a baffle plate is, it is true, conducive to a considerable shortening of the flame and consequently to a much higher compactness of the installation but entails, however, the drawback that upon collision with said baffle plate the distribution of the mixture does not achieve an optimum homogeneity. The result of this defective distribution is that the combustion temperature and the burn-out will not be at the maximum and that the flame will have a relatively small range of adjustability.

The object of the invention is to eliminate this drawback.

According to the invention the burner of the type described above is characterized in that the said inlet ends in a distribution pipe the surface of which is provided with a large number of openings.

A small quantity of the mixture of powder and conveying air (for example 10%) will reach the ignition chamber through the openings in the distribution pipe in the initial part thereof facing away from the combustion chamber and may be ignited by means of a relatively small ignition flame at that location. This ignition will propagate through the mixture supplied via the remaining openings whereby the powder will be ignited in an amount stoechiometrically related to the quantity of pneumatic conveying air. Accordingly a small quantity of powder is initially heated to the ignition temperature and ignited by the ignition flame whereupon the ignited amount of powder increases gradually whereby the temperature is kept high. Only upon reaching the combustion chamber the remaining quantity of combustion air is supplied and the already ignited mixture is burnt as a relatively short hot flame. Within the combustion chamber the mixture becomes highly turbulent so that an intimate mixing is achieved. The absence of a baffle plate at some distance downstream of the distribution pipe together with the utilization of a pattern of openings in said pipe furnishes an optimum distribution. The burn-out may be improved to about 98% or above. The flame will have a high temperature and will be short.

It is of importance that the mixture will flow as much as is possible to the ignition chamber via the openings in the distribution pipe. It is preferred, in particular if the distribution pipe has an open end, that the inlet includes means for imparting a rotary movement to the mixture of powder conveying air along the wall of the distribution pipe provided with openings.

Said means for imparting the rotary movement to the mixture consist of a guide portion debouching tangentially into said distribution pipe. Such a guide portion does not include any moving parts subject to wear. However, the use of a rotated shaft with blades mounted centrally in the distribution pipe is not excluded.

If the end of the distribution pipe facing the combustion chamber is of open construction and the mixture is supplied completely to the ignition chamber via the openings in the distribution pipe there may be generated a suction effect at said open end causing the flame to enter the distribution pipe. This may have a beneficial effect on the ignition.

By employing an exchangeable distribution pipe it is possible to adapt the pattern of openings to the pertaining circumstances (nature of the powder, desired capacity, etc. ).

For a beneficial proceeding of the ignition it may be preferred that the pattern of the openings in the distribution pipe is selected such that the surface area occupied by said openings increases in the direction of the combustion chamber.

Figure 2:
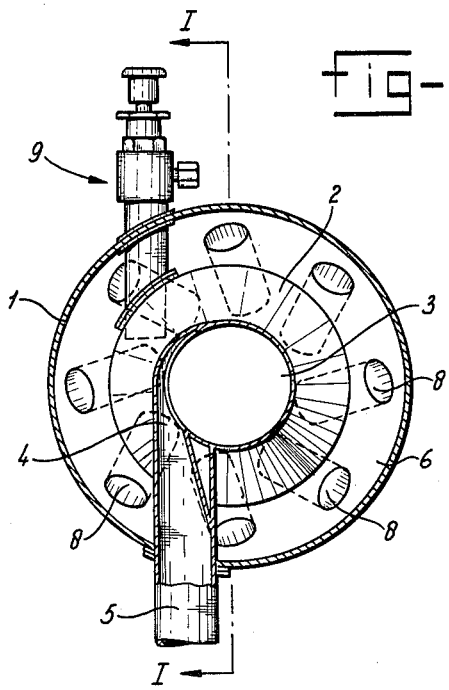

The invention will now be elucidated in further detail with reference to the schematical drawings of which FIG. 1 represents a longitudinal section of a burner according to the invention and FIG. 2 shows a cross section along the line II—II in FIG. 1.

The represented burner for burning pulverized fuel comprises a combustion chamber 1, an ignition chamber 2 connected to said combustion chamber and a distribution pipe 3 mounted within said ignition chamber, a supply line 5 for supplying a mixture of powder (for example pulverized lignite or coal) and air for pneumatic conveyance, said line debouching into said distribution pipe by means of a tangential guide portion 4.

The combustion chamber 1 is elongated thus forming a concentric annular channel 6 with respect to the ignition chamber 2, said concentric annular channel serving as the supply conduit for combustion air to the combustion chamber 1. Between the combustion chamber 1 and the annular channel 6 there is provided an annular plate 7 having mounted therein a number of discharge pipes 8 oriented at an angle with respect to the axis.

Through the outer wall of the annular channel 7 and through the wall of the ignition chamber 2 there extends an ignition burner 9 by means of which a substantially tangential ignition flame may be generated in the initial portion of the ignition chamber.

In the wall of the distribution pipe 3 there is provided a large number of openings 11. The size of these openings increases in the direction of the combustion chamber 1.

The operation of the burner is as follows:

A mixture of pulverized carbonaceous material (for instance lignite or coal) and air for pneumatic conveyance (for instance 10%) is fed to the distribution chamber 3 through the conduit 5 whereby a rotary movement is imparted to said mixture by the tangential guide portion 4. The mixture subject to the rotary movement along the wall of the distribution chamber 3 gradually flows through the openings 11 into the ignition chamber 2. In the initial portion of the distribution chamber a relatively small quantity of the mixture will flow through the relatively small openings 11 into the distribution chamber. Accordingly the ignition flame present on the ignition burner 9 needs only to be small for raising the temperature of this small quantity to the ignition temperature. The small amount of powder thus ignited furnishes such an increase of the temperature that part of the remainder of the mixture fed through the remaining openings into the chamber 2 is gradually ignited.

The gradually ignited, well distributed mixture flows into the combustion chamber 1 and is brought in a highly turbulent condition by the combustion air fed through the pipes 8. This highly turbulent condition is conducive to an intimate mixing. A short flame at a high temperature is formed. The burn-out is substantially complete (about 95% or above). The ignition is simple due to the gradual character thereof.

Prime importance must be attached to the homogeneous distribution which is achieved by employing the distribution pipe 3 provided with openings 11. In this homogeneous distribution a beneficial role is also plaid by the rotary movement of the mixture along the wall of the distribution pipe.

It is preferred that the surface area occupied by the openings 11 is of such magnitude that the fed amount of powder will entirely reach the ignition chamber 2 through these openings. There will then be generated a suction effect at the open end of the chamber 3 causing the flame to be drawn into the chamber 3 which is of advantage with respect to the temperature of the mixture.

Within the broad scope of the invention there also comes a design having a distribution pipe whose end facing the combustion chamber is closed and in which no rotary movement is imparted to the mixture of powder and air for pneumatic conveyance within the distribution pipe. The distribution pipe may also be of a non-cylindrical construction, for example a construction having a venturi throat. The wall of the pipe may be provided with ribs. The distributing openings may be of a special shape. Furthermore is it possible that the distribution pipe is of a type expanding to both its ends.

The distribution pipe 3 is exchangeable so that the pattern of openings may be adapted to the pertaining circumstances.

The combustion air fed into the combustion chamber through the channel 6 and the pipes 8 might also be fed laterally in a alternative embodiment in which the channel 6 might be omitted.

Within the scope of the invention are yet other alternative constructional embodiments feasible.

These alternative embodiments should, however, meet the condition that a small quantity of powder together with air is brought at the ignition temperature and ignited and the amount of ignited powder gradually increases while providing for a uniform distribution.

I claim:

1. A burner for burning pulverized fuel, said burner comprising a combustion chamber, an ignition chamber connected to said combustion chamber, means for supplying combustion air to said combustion chamber at approximately the location of the connection between the ignition chamber and the combustion chamber, a distribution pipe in said ignition chamber, means for delivering a mixture of pulverized fuel and pneumatic conveying air to one end of said distribution pipe, said delivery means including means for imparting rotary movement to the mixture of fuel and air causing it to flow along the wall of th distribution pipe, said distribution pipe having a plurality of openings distributed circumferentially and axially along the wall thereof allowing the mixture of fuel and air to flow gradually outwardly of said distribution pipe into said ignition chamber as it flows through the pipe in an axial direction, the end of the distribution pipe remote from said delivery means opening toward the combustion chamber, and an ignition device in said ignition chamber disposed outwardly of said distribution pipe for igniting the mixture of fuel and air as it exits the distribution pipe through said openings.

2. The burner claimed in claim 1, said distribution pipe being exchangeable and replaceable by a pipe having a different pattern of openings.

3. The burner claimed in claim 1, wherein the pattern of the openings in the distribution pipe is such that the surface area occupied by the openings increases in the axial direction of flow of the mixture of fuel and air therethrough.

* * * * *

UNITED STATES PATENT AND TRADEMARK OFFICE

CERTIFICATE OF CORRECTION

PATENT NO. : 4,397,295

DATED : August 9, 1983

INVENTOR(S) : Aalbert Bakker

It is certified that error appears in the above-identified patent and that said Letters Patent is hereby corrected as shown below:

On the title page insert:

-- [73] Assignee: Technisch Advies- En Handelsbureau "Toverco" B.V., El Zwijndrecht, The Netherlands --.

Claim 1, line 12, "th" should read -- the --.

Signed and Sealed this

*Twelfth* Day of *March 1985*

[SEAL]

*Attest:*

DONALD J. QUIGG

*Attesting Officer* *Acting Commissioner of Patents and Trademarks*